US011103116B2

(12) United States Patent
Lawson McLean et al.

(10) Patent No.: US 11,103,116 B2
(45) Date of Patent: Aug. 31, 2021

(54) VACUUM CLEANER

(71) Applicant: Dyson Technology Limited, Wiltshire (GB)

(72) Inventors: Nathan Lawson McLean, Bristol (GB); Kristian Richard Thomas King, Swindon (GB); Leanne Joyce Garner, Bristol (GB); Adam James Bates, Oxford (GB); Thomas Douglas Ridley, Bristol (GB); David Alan Millington, Swindon (GB); David Nicholas Boyce, Nottingham (GB)

(73) Assignee: Dyson Technology Limited, Malmesbury (GB)

( * ) Notice: Subject to any disclaimer, the term of this patent is extended or adjusted under 35 U.S.C. 154(b) by 313 days.

(21) Appl. No.: 16/225,151

(22) Filed: Dec. 19, 2018

(65) Prior Publication Data

US 2019/0183305 A1 Jun. 20, 2019

(30) Foreign Application Priority Data

Dec. 20, 2017 (GB) ..... 1721489

(51) Int. Cl.
*A47L 9/28* (2006.01)
*A47L 5/28* (2006.01)
(Continued)

(52) U.S. Cl.
CPC ..... *A47L 9/2857* (2013.01); *A47L 5/24* (2013.01); *A47L 5/28* (2013.01); *A47L 9/127* (2013.01); *A47L 9/32* (2013.01)

(58) Field of Classification Search
CPC . A47L 9/2857; A47L 5/24; A47L 5/28; A47L 9/127; A47L 9/32
See application file for complete search history.

(56) References Cited

U.S. PATENT DOCUMENTS 7,624,473 B2 12/2009 Kegg et al.
8,230,551 B2 7/2012 Borgerink et al.
(Continued)

FOREIGN PATENT DOCUMENTS

CN 2624804 7/2004
CN 202341942 7/2012
(Continued)

OTHER PUBLICATIONS

Dyson. (2014) "Dyson V6 Operating Manual," located at <https://www.dyson.com/content/dam/dyson/maintenance/user-guides/us/cordless-vacuums/sticks/v6/dyson-stick-V6-SV04-motorhead-vacuum-user-guide> visited on Feb. 7, 2019. 20 pages.
(Continued)

*Primary Examiner* — Andrew A Horton
(74) *Attorney, Agent, or Firm* — Morrison & Foerster LLP

(57) ABSTRACT

A handheld vacuum cleaner includes a pistol grip which is positioned generally transverse to a longitudinal axis of the vacuum cleaner that runs from a front end to a rear end thereof. It also includes an air inlet positioned forward of the pistol grip, and a vacuum motor configured to draw dirty air into a dirt separator of the vacuum cleaner through the air inlet and exhaust clean air from the vacuum cleaner through an air outlet. The handheld vacuum cleaner further includes an electronic visual display which faces generally rearwards. The handheld vacuum cleaner may be part of a stick vacuum cleaner.

14 Claims, 4 Drawing Sheets

(51) Int. Cl.

| | |
|---|---|
| ***A47L 5/24*** | (2006.01) |
| ***A47L 9/12*** | (2006.01) |
| ***A47L 9/32*** | (2006.01) |

(56) References Cited

U.S. PATENT DOCUMENTS

| | | | | |
|---|---|---|---|---|
| 8,683,645 | B2 | 4/2014 | Glassman | |
| 8,726,457 | B2 | 5/2014 | Liu et al. | |
| 9,055,848 | B2 | 6/2015 | Liu et al. | |
| 9,364,127 | B2 | 6/2016 | Conrad | |
| 9,693,667 | B2 | 7/2017 | Cunningham | |
| 9,962,047 | B2 | 5/2018 | Brown et al. | |
| 2008/0222836 | A1* | 9/2008 | Cunningham | A47L 9/2831 15/314 |
| 2012/0152280 | A1 | 6/2012 | Bosses et al. | |
| 2016/0051103 | A1 | 2/2016 | Jang et al. | |
| 2017/0056197 | A1 | 3/2017 | Weiman et al. | |
| 2017/0079491 | A1 | 3/2017 | Dimbylow | |
| 2017/0215664 | A1 | 8/2017 | Conrad et al. | |
| 2017/0265696 | A1* | 9/2017 | Conrad | A47L 9/2884 |
| 2017/0280951 | A1* | 10/2017 | Nam | A47L 5/24 |
| 2017/0296007 | A1 | 10/2017 | Warren | |
| 2017/0303755 | A1 | 10/2017 | Conrad et al. | |

FOREIGN PATENT DOCUMENTS

| | | | |
|---|---|---|---|
| CN | 104154008 | A | 11/2014 |
| CN | 206063063 | | 4/2017 |
| CN | 106859485 | A | 6/2017 |
| CN | 206612744 | U | 11/2017 |
| DE | 1319937 | | 12/1994 |
| DE | 102014115368 | | 4/2016 |
| DE | 102015100353 | | 7/2016 |
| EP | 2113182 | | 7/2011 |
| EP | 2186463 | | 1/2012 |
| EP | 3108789 | | 12/2016 |
| GB | 2288115 | | 10/1995 |
| JP | 2012-135384 | | 7/2012 |
| JP | D1579985 | | 6/2017 |
| KR | 10-0937254 | | 1/2010 |
| KR | 10-1233157 | | 2/2013 |
| KR | 10-2015-0019294 | | 2/2015 |
| KR | 10-2017-0112861 | A | 10/2017 |
| WO | 2015/107559 | | 7/2015 |
| WO | 2018/036123 | | 3/2018 |

OTHER PUBLICATIONS

International Search Report and Written Opinion dated Feb. 19, 2019, directed to International Application No. PCT/GB2018/053497; 13 pages.

"Dyson v6 Operating Manual," (2017) operating manual published by Dyson Technology Limited; 13 pages.

Search Report dated Jun. 19, 2018, directed to GB Application No. 1721489.1; 2 pages.

Notice of Reasons for Rejection dated Mar. 16, 2020, directed to JP Application No. 2018-237240; 10 pages.

The First Office Action dated Jul. 23, 2020, directed to CN Application No. 201811563538.8; 20 pages.

* cited by examiner

VACUUM CLEANER

REFERENCE TO RELATED APPLICATIONS

This application claims priority of United Kingdom Application No. 1721489.1, filed Dec. 20, 2017, the entire contents of which are incorporated herein by reference.

FIELD OF THE INVENTION

The present invention relates to the field of vacuum cleaners. More specifically, it relates to handheld vacuum cleaners, and to 'stick' vacuum cleaners of the general type comprising a handheld vacuum cleaner which is attached to a cleaner head by an elongate rigid wand.

BACKGROUND OF THE INVENTION

Broadly speaking, there are four types of vacuum cleaner: 'upright' vacuum cleaners, 'cylinder' vacuum cleaners (also referred to as 'canister' vacuum cleaners), 'handheld' vacuum cleaners and 'stick' vacuum cleaners. Upright cleaners and cylinder cleaners are well known. They tend to be mains-operated and are used for relatively heavy-duty cleaning applications.

Handheld vacuum cleaners are relatively small, highly portable vacuum cleaners, suited particularly to relatively low duty applications such as spot cleaning floors and upholstery in the home, interior cleaning of cars and boats etc. Unlike upright cleaners and cylinder cleaners, they are designed to be carried in the hand during use, and tend to be battery-operated.

Broadly speaking, there are two distinct types of stick vacuum cleaner. The first type is, in a sense, an ultra slim-line upright cleaner, though usually battery powered rather than mains operated. The second type of stick-vac cleaner is a spin-off from the handheld vacuum cleaner, and comprises a handheld vacuum cleaner in combination with a rigid, elongate suction wand which effectively reaches down to the floor so that the user may remain standing while cleaning a floor surface. A floor tool is typically fixedly attached to the end of the rigid, elongate suction wand, or alternatively may be integrated with the bottom end of the wand.

Some handheld vacuum cleaners and stick vacuum cleaners of the second type are able to monitor a parameter such as the cleaning mode of the vacuum cleaner (for instance vacuum motor power level), the remaining battery life, or the existence of error conditions such as the presence of a blockage. In some cases the vacuum cleaner can provide a user with information based on one of these parameters, for instance by illuminating a light to indicate that the vacuum cleaner is in a max suction mode, or pulsing the vacuum motor to provide an audible indication that the vacuum cleaner is blocked. However, in known arrangements the indications provided to the user can require interpretation, the information that can be conveyed is limited, and/or the indication can go unnoticed by the user.

SUMMARY OF THE INVENTION

According to a first aspect, a handheld vacuum cleaner includes a pistol grip which is positioned generally transverse to a longitudinal axis of the vacuum cleaner that runs from a front end to a rear end thereof; an air inlet positioned forward of the pistol grip; a vacuum motor configured to draw dirty air into a dirt separator of the vacuum cleaner through the air inlet, and exhaust clean air from the vacuum cleaner through an air outlet; and an electronic visual display which faces generally rearwards.

In use, the user holds the vacuum cleaner by the pistol grip and 'points' the longitudinal axis towards an area to be cleaned in a manner akin to pointing a pistol at a target, so as to direct the air inlet (or a suction tool attached thereto) to that area. The electronic visual display facing generally rearwards means that it more clearly visible to the user during use. In contrast, if the electronic visual display faced in a different direction, the user may have to discontinue use and reposition the vacuum cleaner so as to view the electronic visual display.

The presence of an electronic visual display on a handheld vacuum cleaner may be somewhat counter-intuitive in that such vacuum cleaners are generally battery powered, therefore electrical power is at a premium and steps are generally taken to ensure that as much power as possible is delivered to the vacuum motor rather than peripheral systems. However, the inventors of the present application have discovered that presence of the electronic visual display can allow the remaining power to be used more efficiently (for instance by alerting the user that the vacuum cleaner is blocked so that they do not waste power attempting to continue use), and/or offer a greater level of 'user friendliness', thereby compensating for the power used by the electronic visual display itself.

It is to be understood that an electronic visual display is distinct from a single light. Such a light has two conditions, on or off, whereas a display device is capable of displaying at least three different conditions. For instance, the display device may comprise an array of lights which can be lit in different combinations (for example a single digit seven segment display, which comprises an array of elongate lights which can be light in combinations to display the digits 0-9).

Reference to the handheld vacuum cleaner having a longitudinal axis is not intended to imply that the handheld vacuum cleaner is elongate or comprises an elongate component. Rather, the longitudinal axis of a handheld vacuum cleaner may be considered to be the direction in which the user 'points' the vacuum cleaner to direct it. Nonetheless, in some embodiments the handheld vacuum cleaner may comprise an elongate body the longitudinal axis of which is collinear with the longitudinal axis of the vacuum cleaner. Said elongate body may be, for example, a main body, a motor housing, a rotational axis of a dirt separation stage or an elongate duct section of the air inlet.

For the avoidance of doubt, reference to the handheld vacuum cleaner exhausting clean air is intended to mean that some dirt entrained therein has been removed by the dirt separator. It is not intended to imply that the 'clean' air has had all dirt removed therefrom.

The pistol grip is preferably positioned at an angle of more than 50 degrees, for instance more than 60 degrees or more than 70 degrees to the longitudinal axis. In some embodiments the pistol grip may be positioned substantially perpendicular to the longitudinal axis. However, the pistol grip is preferably positioned at an angle of less than 85 degrees or less than 80 degrees to the longitudinal axis. This may allow the position of the user's hand to be positioned more naturally, thereby making the handheld vacuum cleaner more comfortable to use for extended periods.

The pistol grip is preferably positioned so that the longitudinal axis is substantially parallel to (for instance in line with) the forearm of a user when the user grips the pistol grip with a straight wrist. This may make the handheld vacuum cleaner more comfortable to use and/or more intuitive to point in different directions.

The electronic visual display may be a screen.

This may provide an advantageously high resolution display, thereby allowing more information and/or a wider range of different pieces of information to be presented to the user. For example, if the electronic visual display was a screen then it may be capable of showing an image, whereas if the electronic visual display was a single digit seven segment display then the information which the display could show would be limited to the digits 0-9 (possibly with the addition of other patterns such as may denote the letters E, L, b, h, etc.).

The screen may be an LCD screen such as a TFT screen, an LED screen such as an OLED screen, or any other suitable type of screen such as an 'e-paper' screen.

As an alternative, the electronic visual display may comprise an array of individual lights (for instance a seven segment display of one or more digits, for instance, two, three, four or more digits). This may reduce the cost of the vacuum cleaner.

The electronic visual display may be configured to selectively display at least two different colours.

For instance, where the display is a screen said screen may be a full colour screen.

The electronic visual display being able to display different colours can allow more information to be displayed than a monotone display, and/or may allow the information presented to the user to be more intuitive. For instance, the display may show an error message in red and an all-clear message in green, providing the user with an indication of the state of the vacuum cleaner at a glance without relying on them reading the message.

As an alternative, the electronic visual display may be a monotone display such as an array of single colour lights, or a monochrome screen. This may reduce the cost of the vacuum cleaner.

The electronic visual display may be substantially planar, and positioned at an angle of no more than 20 degrees to the longitudinal axis.

For instance, the electronic visual display may be positioned at an angle of no more than 10 degrees to the longitudinal axis or may be substantially normal to the longitudinal axis. This may increase the visibility of the electronic visual display by reducing the viewing angle when the user looks along the longitudinal axis.

The electronic visual display may be positioned axially rearwards of the pistol grip.

This may make the electronic visual display easier for the user to see, for instance avoiding the possibility of the pistol grip (or the user's hand) obscuring part of the electronic visual display.

As an alternative, the electronic visual display may be positioned axially in line with or in front of the pistol grip, in which case it may be displaced from the pistol grip in a radial direction about the longitudinal axis so as to reduce the risk of the pistol grip (or the user's hand) obscuring it.

The pistol grip may be positionable in a generally vertical orientation when the longitudinal axis is horizontal, the pistol grip extending from a lower end configured to be gripped by the little finger and/or ring finger of the user to an upper end configured to be gripped by the index finger and/or middle finger of the user, and the electronic visual display may be positioned radially above the pistol grip.

This may position the electronic visual display advantageously close to the line of sight of a user during use. For instance, the electronic visual display may be positioned at a location equivalent to the rear sight of a pistol.

As an alternative, the electronic visual display may be positioned to one side of the pistol grip (whereupon the user may view the display more clearly by rotating the vacuum cleaner slightly about the longitudinal axis.

The electronic visual display may project through or be visible through an aperture in a user-removable component.

This may allow both the user-removable component and the electronic visual display to be located in the same area of the handheld vacuum cleaner (for instance a particularly clearly visible and/or easily accessible area) without the electronic visual display needing to be mounted on the user-removable component (which may complicate the power and/or data supply to the electronic visual display).

The aperture may be fully enclosed (for instance it may be a circular through-hole), or may be open-sided (for instance the aperture may be U-shaped and encircle only a portion of the circumference of the electronic visual display).

The user-removable component may be generally annular. For example, the user-removable component may fit around a component of the handheld vacuum cleaner (for instance a motor housing or a component thereof such as an inner core) like a sleeve.

The user-removable component may be removable from the handheld vacuum cleaner by moving it in the direction of the longitudinal axis.

The user removable component may comprise a pre-motor filter member which is positionable in a fluid path upstream of the vacuum motor.

The filter member is preferably positionable downstream of the dirt separator.

Instead or as well, the user removable component may comprise a post-motor filter member which is positionable in a fluid path downstream of the vacuum motor.

The removable component may provide the air outlet of the vacuum cleaner.

The removable component comprising both pre-motor and post-motor filter members may be particularly advantageous in that both filter members can be removed together for cleaning or other maintenance, which may make the vacuum cleaner more user friendly.

As an alternative, the screen may be visible through or project through an aperture in non-removable component. The non-removable component may be a filter assembly which comprises a pre-motor filter member and/or a post-motor filter member.

The handheld vacuum cleaner may further comprise a control member configured to receive a control input from a user, the control member being positioned adjacent to the electronic visual display.

This may allow the user to view the display and operate the control member at the same time, rather than having to re-orient the vacuum cleaner between viewing the electronic visual display and looking at the control member to operate it.

The control member may be, for example, a push-button, a rotatable knob or a slider. The control member may be an on/off switch for the vacuum motor, a mode select switch (such as a vacuum motor speed control), and/or a switch which is configured to change the information which is displayed on the electronic visual display.

The vacuum cleaner may comprise a plurality of control members positioned adjacent to the electronic visual display.

The control member may face generally rearwards.

For instance where the control member is a push-button the button may be movable generally in a direction parallel to (for instance collinear with) the longitudinal axis, or where the control member is a rotatable knob the knob may project along and be rotatable around an axis which is parallel to the longitudinal axis.

This may make the control member particularly easy to operate when viewing the electronic visual display, and/or may make it easier for the user to view the state of the control member (for instance the rotational position of a knob) while looking at the electronic visual display.

As an alternative, the control member may face in any other suitable direction. For instance the control member may be a knob which projects generally laterally, and can be rotated 'up' or 'down' by the user when looking at the electronic visual display.

The longitudinal axis may intersect the electronic visual display.

This may make the electronic visual display easier to see when the user is looking along the longitudinal axis than if the electronic visual display were positioned offset to the longitudinal axis.

The dirt separator may have a generally cylindrical outer wall which is substantially concentrically positioned around the longitudinal axis.

Alternatively the dirt separator may take any other suitable form. For example, it may define an outer wall of any other suitable shape, or may define a generally cylindrical outer wall which is positioned about an axis which is parallel to or perpendicular to the longitudinal axis.

Said outer wall may define a dirt collection chamber.

Alternatively or in addition, the outer wall may define the perimeter of an inertial separator such as a cyclonic separator.

The longitudinal axis may intersect the suction inlet. The air inlet may define an inlet axis. The inlet axis may be parallel to, for instance collinear with, the longitudinal axis of the handheld vacuum cleaner.

The motor may define an axis about which its rotor rotates, said axis being parallel to (for instance collinear with) the longitudinal axis.

The electronic visual display may be positioned behind the vacuum motor.

The handheld vacuum cleaner may comprise a battery arranged to power the vacuum motor and/or the screen. The battery is preferably rechargeable. Instead or as well, the battery may be part of a user-removable battery pack.

The handheld vacuum cleaner preferably comprises a first housing positioned at one end of the pistol grip, and a second housing positioned at the other end of the pistol grip. Where the handheld vacuum cleaner comprises a battery, the first housing may contain the vacuum motor and the second housing may contain the battery. This may distribute the weight of the vacuum cleaner more evenly about the pistol grip, thereby making the handheld vacuum cleaner more manoeuvrable and/or more comfortable to use for extended periods.

Where the pistol grip extends from a lower end configured to be gripped by the little finger and/or ring finger of the user to an upper end configured to be gripped by the index finger and/or middle finger of the user, the first housing may be positioned at the upper end of the pistol grip and the second housing may be positioned at the lower end of the pistol grip.

The pistol grip may join the first and second housings to one another. The handheld vacuum cleaner may further comprise a support strut which runs between the first and second housings. The first and second housings being joined together by both the pistol grip and the support strut may improve the strength and/or rigidity of the handheld vacuum cleaner.

The dirt separator may be supported by the first housing and/or the second housing. For example, the dirt separator may be supported by or contained within the first housing.

According to a second aspect, a stick vacuum cleaner includes a handheld vacuum cleaner according to any of the above embodiments; a cleaner head defining a suction opening; and an elongate rigid wand defining a suction path which extends from the cleaner head to the air inlet of the handheld vacuum cleaner, the wand being positioned substantially parallel to longitudinal axis.

The wand may be substantially collinear with the longitudinal axis.

The wand may preferably be removably connected to the handheld vacuum cleaner and the cleaner head.

BRIEF DESCRIPTION OF THE DRAWINGS

Embodiments of the present invention will now be described, by way of example only, with reference to the accompanying drawings in which.

Throughout the description and drawings, corresponding reference numerals denote corresponding features.

DETAILED DESCRIPTION OF THE INVENTION

Figure 1:
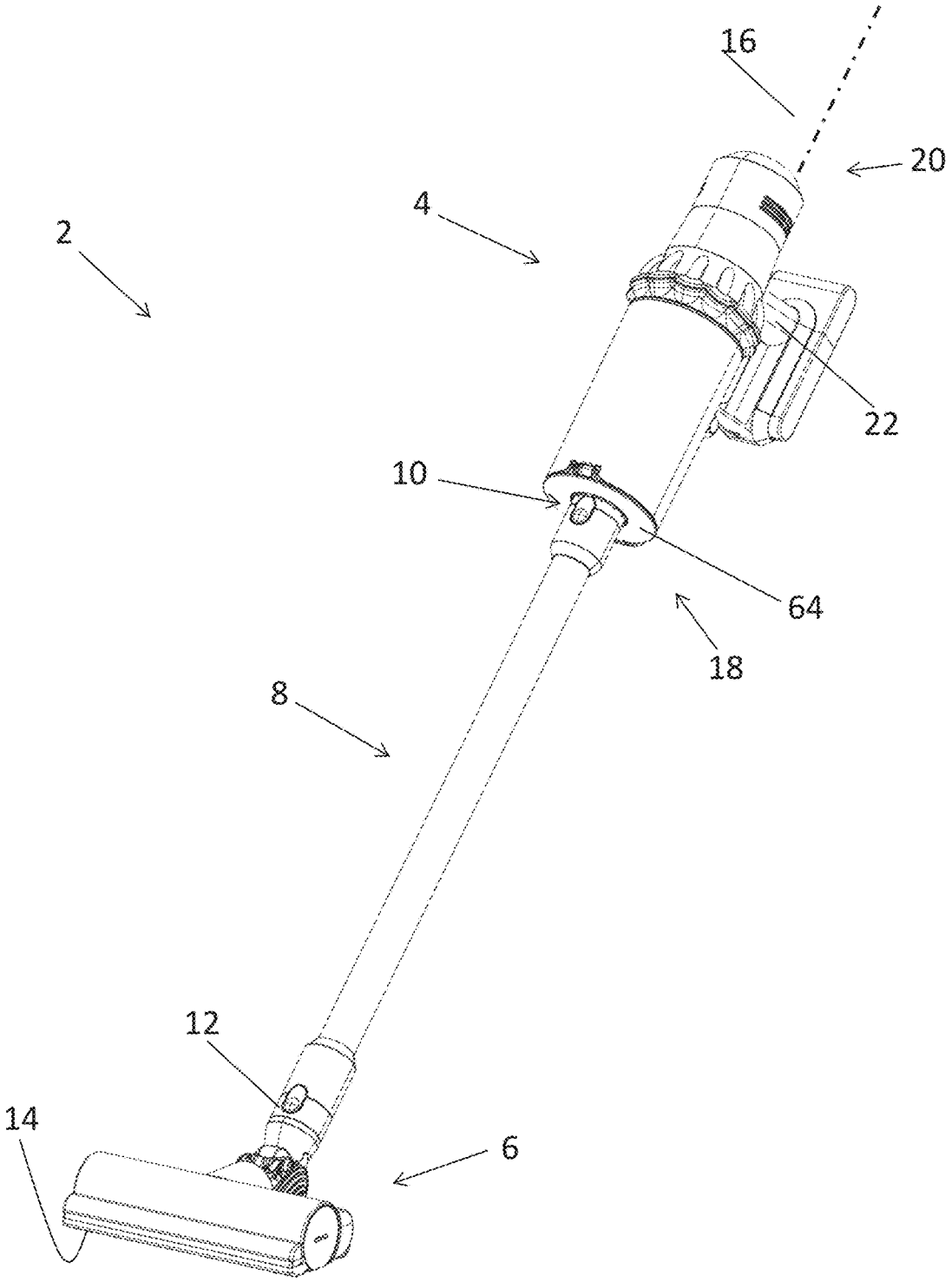
FIG. 1 is a perspective view of a stick vacuum cleaner according to an embodiment of the present invention.

FIG. 1 shows a stick vacuum cleaner 2 according to an embodiment of the invention. The stick vacuum cleaner comprises a handheld vacuum cleaner 4 which is connected to a floor tool 6 in the form of a cleaner head by an elongate rigid wand 8. In this case the wand is attachable to an air inlet 10 of the handheld vacuum cleaner, and to a rear duct 12 of the cleaner head 6. The wand 8 is generally tubular, the space inside forming a suction path which extends from the cleaner head 6 to the air inlet 10 of the handheld vacuum cleaner 4.

The cleaner head 6 has a sole plate 14 which is configured to engage a floor surface, and which has a suction opening (not visible) through which dirty air (i.e. air with entrained dirt) from the floor surface can be sucked into the cleaner head 6. In use, a vacuum motor (not visible) housed in the handheld vacuum cleaner 4 generates suction at the air inlet 10. Dirty air from a floor surface is drawn into the cleaner head 6 through the suction opening (not visible) in the sole plate 10, then runs along the inside of the wand 8 and into the air inlet 10 of the handheld vacuum cleaner.

The wand 8 is releasably attachable to the handheld vacuum cleaner 4, so that the handheld vacuum cleaner can be used on its own (or with a tool attached to the air inlet 10). The wand 8 is also releasably attachable to the cleaner head 6, so that different floor tools can be fitted to the wand. Furthermore, the rear duct 12 of the cleaner head 6 can be attached directly to the air inlet 10 of the handheld vacuum cleaner so that the cleaner head 6 can be used in conjunction with the handheld vacuum cleaner 4 rather than being limited to use as part of the stick vacuum cleaner 2.

The handheld vacuum cleaner 4 defines a longitudinal axis 16 which runs from a front end 18 of the handheld vacuum cleaner to a rear end 20. The longitudinal axis 16 intersects the air inlet 10. When it is attached to the handheld vacuum cleaner 4, the wand 8 is parallel to (and in this case collinear with) the longitudinal axis 16. The handheld vacuum cleaner further comprises a pistol grip 22 which is positioned transverse to the longitudinal axis 16. The pistol grip 22 is positioned rearward of the air inlet 10, i.e. the axial position of the pistol grip is further towards the rear end 20 than the air inlet. In other words, the air inlet 10 is positioned forward of the pistol grip 22 (in that the axial position of the air inlet is further towards the front end 18 than the pistol grip).

Figure 2:
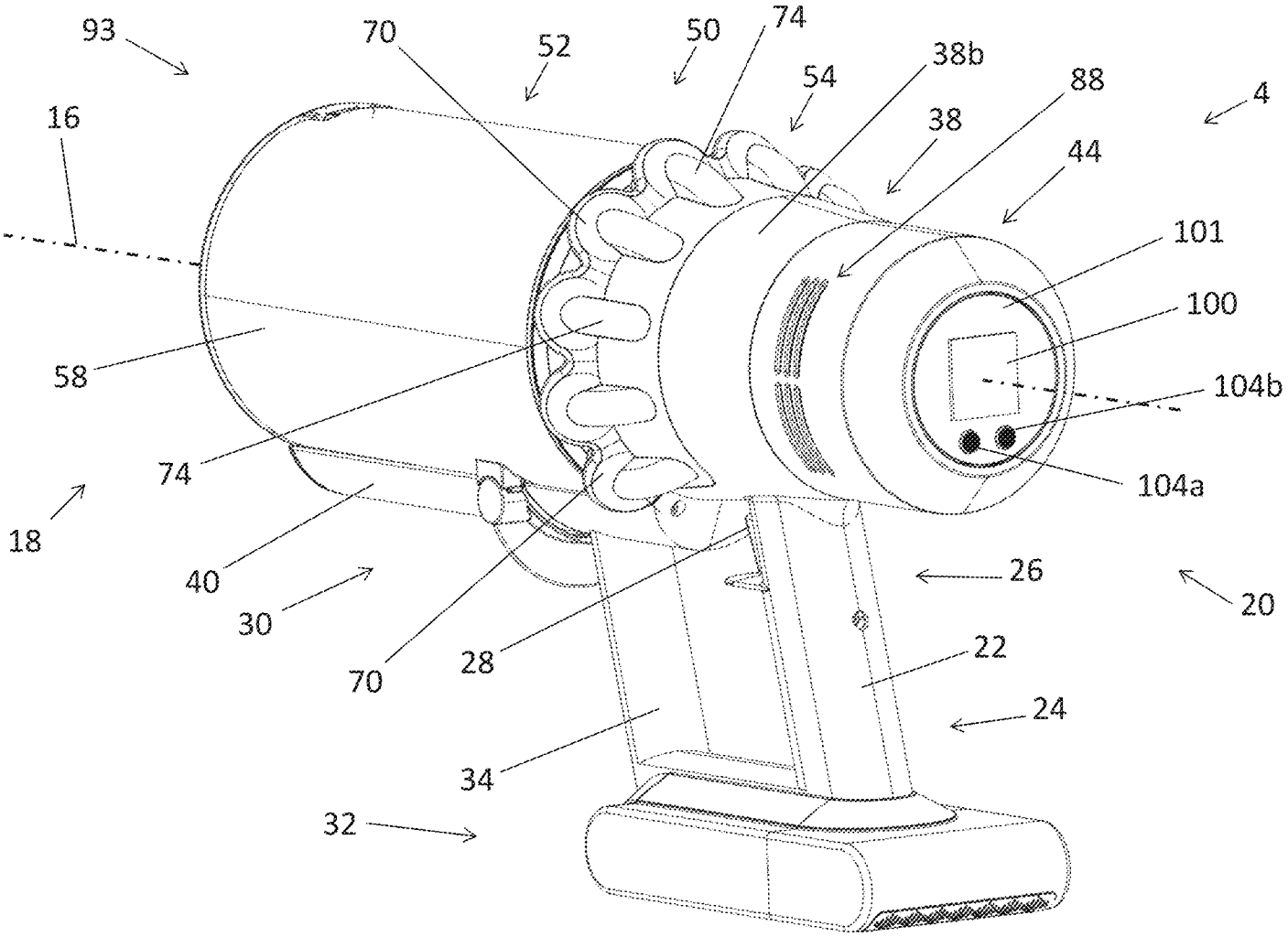
FIG. 2 is a perspective view of a handheld vacuum cleaner of the stick vacuum cleaner of FIG. 1.
Figure 3:
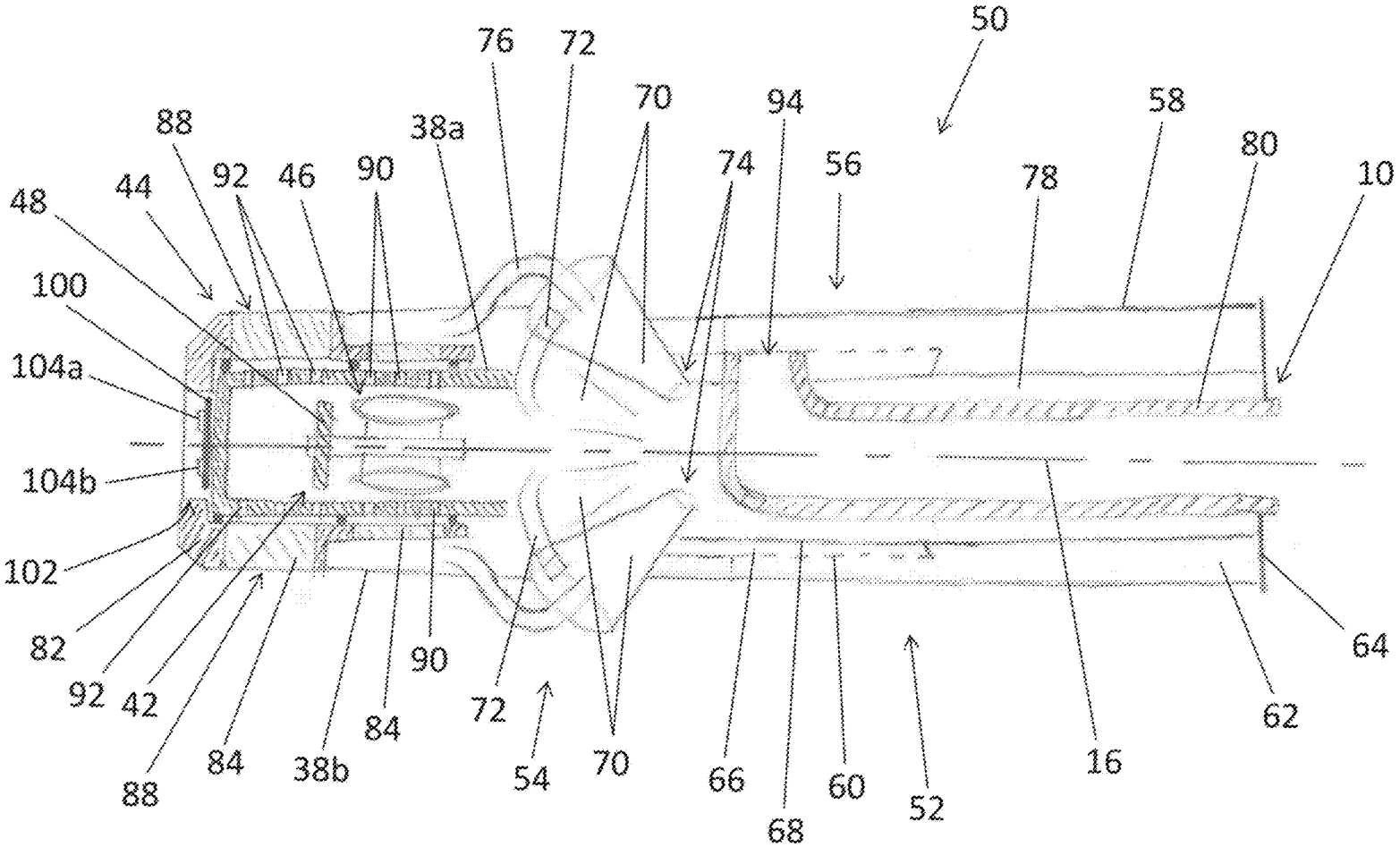
FIG. 3 is a schematic cross-sectional view through the handheld vacuum cleaner of FIG. 2.

The handheld vacuum cleaner 4 will now be described in more detail with reference to FIGS. 2 and 3, which show the handheld vacuum cleaner 4 in isolation, in conjunction with FIG. 1.

As noted above, the pistol grip 22 is positioned transverse to the longitudinal axis 16. In this case, the pistol grip 22 is positioned at an angle of around 75 degrees to the longitudinal axis 16. As shown in FIGS. 1-3, with the handheld vacuum cleaner 4 positioned with the longitudinal axis 16 horizontal, the pistol grip 22 can positioned in a generally vertical orientation, running from a lower end 24 to an upper end 26. The upper end 26 has a trigger 28 which forms the on/off switch for the handheld vacuum cleaner 4.

The handheld vacuum 4 cleaner comprises a first housing 30 positioned at the upper end 26 of the pistol grip 22, and a second housing 32 positioned at the lower end 24 of the pistol grip 22. The first and second housings 30, 32 are attached to one another by the pistol grip 22, and by a support strut 34 which in this case runs generally parallel to the pistol grip 22.

In this embodiment the handheld vacuum cleaner 4 is battery powered. An array of batteries (not visible) are provided in the second housing 32, the batteries and second housing 32 forming a battery pack. In some embodiments the battery pack may be removable, but in this case it is permanently attached. The batteries are rechargeable, and are charged in situ by plugging a charging cable into a charging port (not shown) of the handheld vacuum cleaner 4.

The first housing 30 comprises a motor housing 38 and a separator support 40. The motor housing 38 is generally elongate and defines a longitudinal axis which is collinear with the longitudinal axis 16. The motor housing 38 houses a vacuum motor 42 and supports a filter assembly 44. The vacuum motor 42 comprises an electric motor 46 and an impeller 48. The electric motor 46 is configured to receive power from the batteries (not visible) so as to drive the impeller 48 to rotate about a motor axis which in this case is collinear with the longitudinal axis 16. Rotation of the impeller 48 creates a flow of air through the handheld vacuum cleaner 4 (as discussed in more detail below) and thereby generates suction at the air inlet 10.

The separator support 40 supports a dirt separator 50 which is configured to remove dirt from the air that is drawn into the handheld vacuum cleaner 4 through the air inlet 10. The dirt separator 50 of this embodiment comprises a first separation stage 52 and a second separation stage 54. The first separation stage 52 has a single cyclone chamber 56 formed by an upper portion of a transparent bin 58, a porous cylindrical shroud 60, and a first dirt collection chamber 62 which is formed by a lower portion of the bin 58 and an openable lid 64. The bin 58 takes the form of a cylindrical outer wall which is concentrically positioned around the longitudinal axis 16. With the bin 58 being concentrically positioned, the rotational axis of the first separation stage 52 (i.e. the rotational axis of the cyclone which forms inside the cyclone chamber 56) is collinear with the longitudinal axis.

Behind the shroud 60 is an air passage 66 which surrounds an inner wall 68 and leads to the second separation stage 54. The second separation stage 54 has a plurality of cyclone chambers 70 arranged in parallel. The cyclone chambers 70 have respective tangential inlets 72 which branch off from the air passage 66, open ends 74 configured as dirt outlets, and air outlets in the form of vortex finders 76. The second separation stage 54 also has a second dirt collection chamber 78 which is defined between the inner wall 40 and a duct 80 of the air inlet 10. The duct 80 is generally elongate, defining an inlet axis which is parallel to, and in this case collinear with, the longitudinal axis 16.

The filter assembly 44 comprises a casing 82, a pre-motor filter member 84 and a post-motor filter member 86. The casing 82 defines a pair of grid-like air outlets 88 through which clean air (i.e. air from which at least some of the entrained dirt had been separated therefrom) is exhausted from the handheld vacuum cleaner 4. The pre-motor filter member 84 is positioned upstream of the vacuum motor 42 and downstream of the dirt separator 50, and is configured to filter out small dirt particles which were not removed by the dirt separator 50 before they can reach the vacuum motor 42. The pre-motor filter member 84 comprises a layered wad of porous felt which in this case including a layer of an electrostatic felt such as is sold under the name Technostaf. The post-motor filter member 86 is positioned downstream of the vacuum motor 42 and upstream of the air outlets 88. The post-motor filter member 86 is configured to filter any dirt particles which may be released by the electric motor 46 (for instance debris from carbon brushes of the electric motor 46). In this case the post-motor filter member 86 is a pleated glass fibre HEPA filter. The filter members 84, 86 are annular in shape and share a common axis, which in this embodiment is collinear with the longitudinal axis 16. Indeed, the entire filter assembly 44 is annular, and is positioned substantially concentrically around the longitudinal axis 16.

In this embodiment the filter assembly 44 is a user-removable component, allowing the user to remove the filter assembly so as to wash or replace the filter members 84, 86. The dirt separator 50, first housing 30 and filter assembly 44 together form an elongate main body 93 the longitudinal axis of which is collinear with the longitudinal axis 16 of the handheld vacuum cleaner. The filter assembly 44 can be removed from the handheld vacuum cleaner 4 by moving it in the direction of the longitudinal axis 16.

Figure 4:
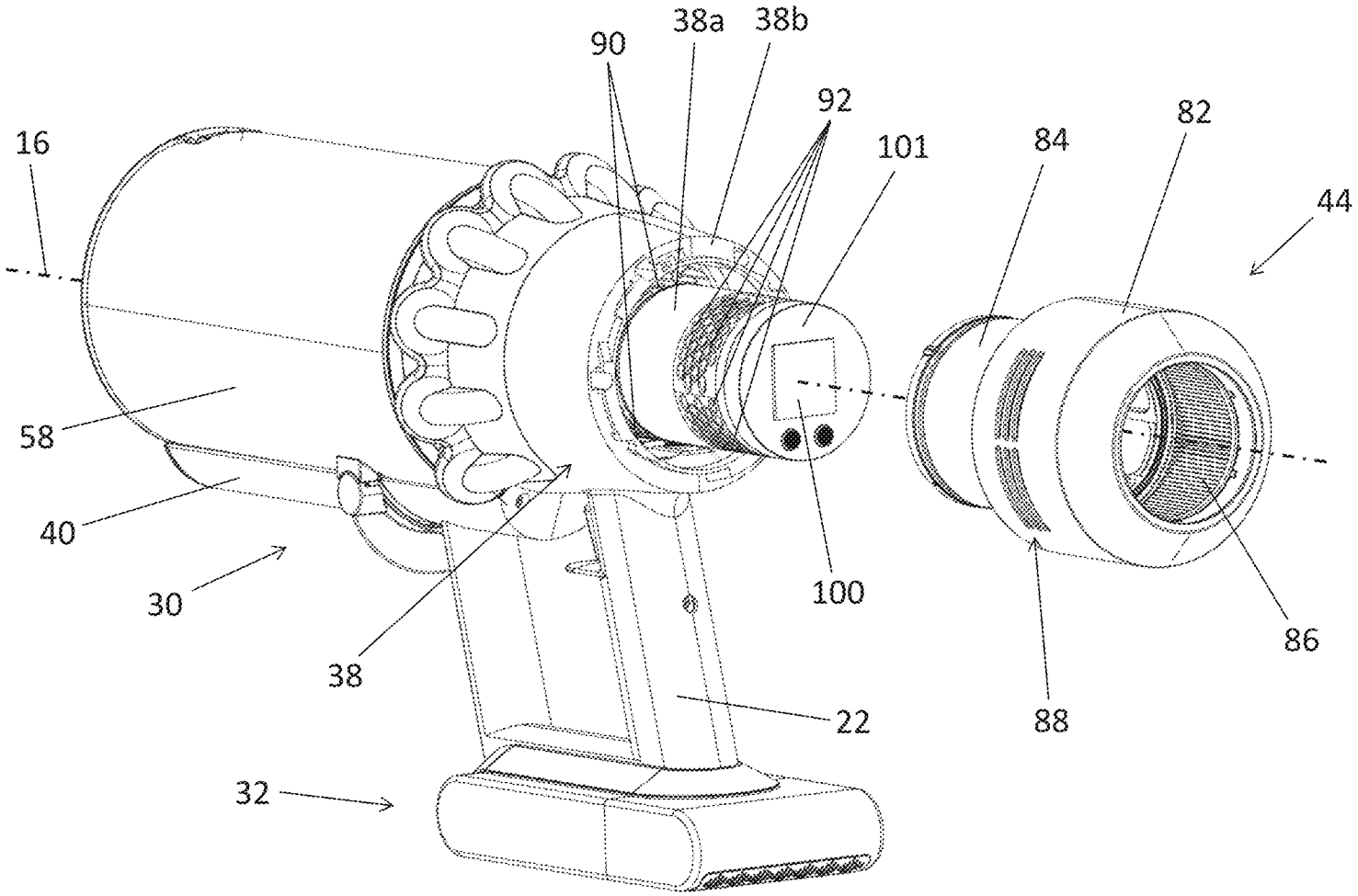
FIG. 4 is a perspective view of the handheld vacuum cleaner of FIGS. 2 and 3, with a removable component separated therefrom.

FIG. 4 shows the handheld vacuum cleaner 4 with the filter assembly 44 removed therefrom. When attached to the handheld vacuum cleaner 4 the filter assembly 44 fits around an inner core **38*a* of the motor housing 38 like a sleeve such that it axially overlaps the vacuum motor 44 (both the electric motor 46 and the impeller 48), and projects into an outer cover 38*b* of the motor housing. The inner core 38*a* has a front array of apertures 90 which provide fluid communication between the pre-motor filter member 84 and the electric motor 46, and a rear array of apertures 92 which provide fluid communication between the electric motor 46 and the post-motor filter member 86**.

The handheld vacuum cleaner 4 comprises an electronic visual display 100 which faces rearwards. It therefore faces generally towards the user during use. In this case the electronic visual display 100 is a screen, more particularly a planar, full colour, backlit TFT screen. The screen 100 is configured to receive power from the batteries (not visible) and display any suitable pieces of information (such as an error message, an indication of the mode the handheld vacuum cleaner 4 is in, or an indication of remaining battery life) to the user.

The screen 100 faces substantially exactly rearwards (i.e. is substantially normal to the longitudinal axis). It is positioned on the first housing 30 (more particularly on the motor housing inner core 38*a*, behind the vacuum motor 42), and is therefore situated radially above the pistol grip 22 for ease of visibility. As well as being above it, the screen 100 lies axially behind the pistol grip 22. Indeed, the screen 100 is positioned on a rearmost surface 101 of the handheld vacuum cleaner so that it cannot be obscured by components of the handheld vacuum cleaner positioned behind it. The screen 100 is located such that it is intersected by the longitudinal axis 16.

The screen 100 is visible through an aperture 102 in the filter assembly 44 which takes the form of a circular through-hole in the casing 82 of the filter assembly 44. In this case the screen 100 is recessed slightly with respect to the casing 82 such that the screen is viewed by looking through the aperture 102. In other cases, however, the core 38 of the motor housing 30 may extend slightly further rearwards such that the screen 100 projects through the aperture 102 and stands proud of the casing 82.

Positioned beneath the screen 100 (in the vertical direction defined by the pistol grip 22) is a pair of control members 104*a*, 104*b*, each of which is positioned adjacent to the screen 100 and is configured to receive a control input from the user. In this case each control member 104*a*, 104*b* takes the form of a push-button (therefore the control input is the user pressing that button). Like the screen, each control member 104*a*, 104*b* faces rearwards. The control members 104*a*, 104*b* are therefore pressed by pushing them forwards in a direction parallel to the longitudinal axis 16.

In this particular embodiment each control member 104*a*, 104*b* is configured to change the mode of the vacuum cleaner. More particularly, pressing the right hand control member 104*b* increases the speed level of the vacuum motor 42 (and thus increases the level of suction) and pressing the left hand control member 104*a* decreases the speed level of the vacuum motor 42.

Use of the stick vacuum cleaner 2 (and by extension the handheld vacuum cleaner 4) will now be described with reference to FIGS. 1-4. The user grips the handheld vacuum cleaner 4 by the pistol grip 22, with their index finger and middle finger gripping the upper end 26 and their ring finger and little finger gripping the lower end 24. This positions the longitudinal axis 16 substantially in line with the user's forearm when their wrist is straight. The user can then point longitudinal axis 16 of the handheld vacuum cleaner 4 towards an area of floor to be cleaned (by moving their forearm and/or wrist), thereby pointing the air inlet 10, wand 8 and cleaner head 6 towards that area.

When the user squeezes the trigger 28 with their index finger, power from the batteries is delivered to the electric motor 46 by wires (not visible) and the electric motor 46 rotates the impeller 48. The impeller creates a flow of air through the vacuum cleaner, drawing air into the air inlet 10 and exhausting it out of the air outlets 88. This creates suction at the air inlet 10 which draws air into the cleaner head 6 and up the wand 8 as described previously.

Dirty air which has entered the air inlet 10 from the cleaner head 6 through the wand 8 passes along the duct 80, an end section 94 of which turns the air flow radially outwards and then directs it to enter the cyclone chamber 56 of the first separation stage 52 tangentially. The air then spirals around the cyclone chamber 56, where coarse dirt is separated therefrom by centrifugal action and is deposited into the first dirt collection chamber 62. Air from which coarse dirt has been separated then passes through the shroud 60, through the air passage 66 and into the second separation stage 54. The air then splits into a series of streams, each of which enters one of the cyclone chambers 70 through its inlet 72 and forms a cyclone therein. Finer dirt is separated by centrifugal action and falls out of the open end 74 of the cyclone chamber 70 into the second dirt collection chamber 78, while air from which the finer dirt has been removed exits the cyclone chamber 70 through its vortex finder 76. From the vortex finders 76, the separate streams are then directed into the filter assembly 44. The air is then directed generally radially inwards, through the pre-motor filter member 84, through the apertures 90 and into the electric motor 46. It then passes out axially of the electric motor 46, through the impeller 48, through the apertures 92 and through the post-motor filter member 86. The clean air then runs out of the handheld vacuum cleaner 4 through the air outlets 88. Intermittently, the lid 64 is opened in known fashion so as to allow dirt to be emptied out of the dirt collection chambers 62, 78.

It will be appreciated that numerous modifications to the above described embodiments may be made without departing from the scope of invention as defined in the appended claims. For instance, in the above embodiment the control members 104*a*, 104*b* increment the speed of the vacuum motor 42 up and down. In other embodiments, however, they may be differently configured. For example, the control members 104*a*, 104*b* may toggle through different display modes in which the screen 100 displays different pieces of information, without affecting the cleaning characteristics of the handheld vacuum cleaner. As another example, one of the control members 104*a*, 104*b* may toggle through vacuum motor speeds and the other may toggle through display modes. As a further example, one of the control members 104*a*, 104*b* may turn the screen 100 on and off, and the other may turn the backlight on or off.

For the avoidance of doubt, the optional and/or preferred features described above may be utilised in any suitable combinations, and in particular in the combinations set out in the appended claims. Features described in relation to one aspect of the invention, may also be applied to another aspect of the invention, where appropriate.

The invention claimed is:

1. A handheld vacuum cleaner comprising:

a pistol grip which is positioned transverse to a longitudinal axis of the vacuum cleaner that runs from a front end to a rear end of the vacuum cleaner;

an air inlet positioned forward of the pistol grip, wherein the longitudinal axis is parallel to the air inlet;

a vacuum motor configured to draw dirty air into a dirt separator of the vacuum cleaner through the air inlet, and exhaust clean air from the vacuum cleaner through an air outlet; and an electronic visual display screen that faces rearward, wherein the electronic visual display projects through or is visible through an aperture in a user-removable component.

2. The handheld vacuum cleaner of claim 1, wherein the electronic visual display is configured to selectively display at least two different colours.

3. The handheld vacuum cleaner of claim 1, wherein the electronic visual display is planar, and is positioned at an angle of no more than 20 degrees to the longitudinal axis.

4. The handheld vacuum cleaner of claim 1, wherein the electronic visual display is positioned axially rearwards of the pistol grip.

5. The handheld vacuum cleaner of claim 1, wherein the pistol grip is positionable in a generally vertical orientation when the longitudinal axis is horizontal, the pistol grip extending from a lower end configured to be gripped by at least one of the little finger and the ring finger of the user to an upper end configured to be gripped by at least one of the index finger and the middle finger of the user, and the electronic visual display is positioned radially above the pistol grip.

6. The handheld vacuum cleaner of claim 1, wherein the user removable component comprises a pre-motor filter member which is positionable in a fluid path upstream of the vacuum motor.

7. The handheld vacuum cleaner of claim 1, wherein the user removable component comprises a post-motor filter member which is positionable in a fluid path downstream of the vacuum motor.

8. The handheld vacuum cleaner of claim 1, further comprising a control member configured to receive a control input from a user, the control member being positioned adjacent to the electronic visual display.

9. The handheld vacuum cleaner of claim 8, wherein the control member faces rearwards.

10. The handheld vacuum cleaner of claim 1, wherein the longitudinal axis intersects the electronic visual display.

11. The handheld vacuum cleaner of claim 1, wherein the dirt separator has a cylindrical outer wall which is concentrically positioned around the longitudinal axis.

12. The handheld vacuum cleaner of claim 11 wherein the outer wall defines a dirt collection chamber.

13. The handheld vacuum cleaner of claim 1, wherein the user-removable component is removable from a body of the vacuum cleaner while the electronic visual display remains affixed to the body of the vacuum cleaner.

14. A stick vacuum cleaner comprising:

a handheld vacuum cleaner comprising:

a pistol grip which is positioned transverse to a longitudinal axis of the vacuum cleaner that runs from a front end to a rear end of the vacuum cleaner, an air inlet positioned forward of the pistol grip, wherein the longitudinal axis is parallel to the air inlet, a vacuum motor configured to draw dirty air into a dirt separator of the vacuum cleaner through the air inlet, and exhaust clean air from the vacuum cleaner through an air outlet, and an electronic visual display screen that faces rearward, wherein the electronic visual display projects through or is visible through an aperture in a user-removable component;

a cleaner head defining a suction opening; and an elongate rigid wand defining a suction path which extends from the cleaner head to the air inlet of the handheld vacuum cleaner, the wand being positioned parallel to the longitudinal axis.

* * * * *